United States Patent [19]

Mitrofanov et al.

[11] Patent Number: 4,568,031

[45] Date of Patent: Feb. 4, 1986

[54] GYRATORY CRUSHER

[76] Inventors: Engeny S. Mitrofanov, ulitsa Kibalchicha 4, korpus 1, kv. 17; Boris G. Ivanov, ulitsa Basseinaya 5, kv. 8; Nikolai A. Ivanov, Nova Izmailovsky prospekt, 19, kv.26, all of Leningrad, U.S.S.R.

[21] Appl. No.: 576,760

[22] Filed: Feb. 3, 1984

[51] Int. Cl.[4] ..... B02C 2/06

[52] U.S. Cl. ..... 241/210; 241/215

[58] Field of Search ..... 241/207–216

[56] References Cited

U.S. PATENT DOCUMENTS 4,452,401 6/1984 Zarogatsky et al. ..... 241/210 X

FOREIGN PATENT DOCUMENTS 578098 10/1977 U.S.S.R. ..... 241/209

*Primary Examiner*—Mark Rosenbaum

*Attorney, Agent, or Firm*—Lilling & Greenspan

[57] ABSTRACT

A gyratory crusher comprises a housing having arranged therein an adjustment ring with an upper support of a crushing cone provided with a ball joint fixed in position in a cross-piece of the adjustment ring. The crushing cone has a shaft pressed thereinto and inserted by its upper end to the ball joint for the ball joint to be capable of displacement along the shaft. The crushing cone is placed on a spherical surface of a thrust element which bears on a cup member to slide thereon. The lower shank of the shaft is provided with an accentric rotatable by a drive means.

2 Claims, 1 Drawing Figure

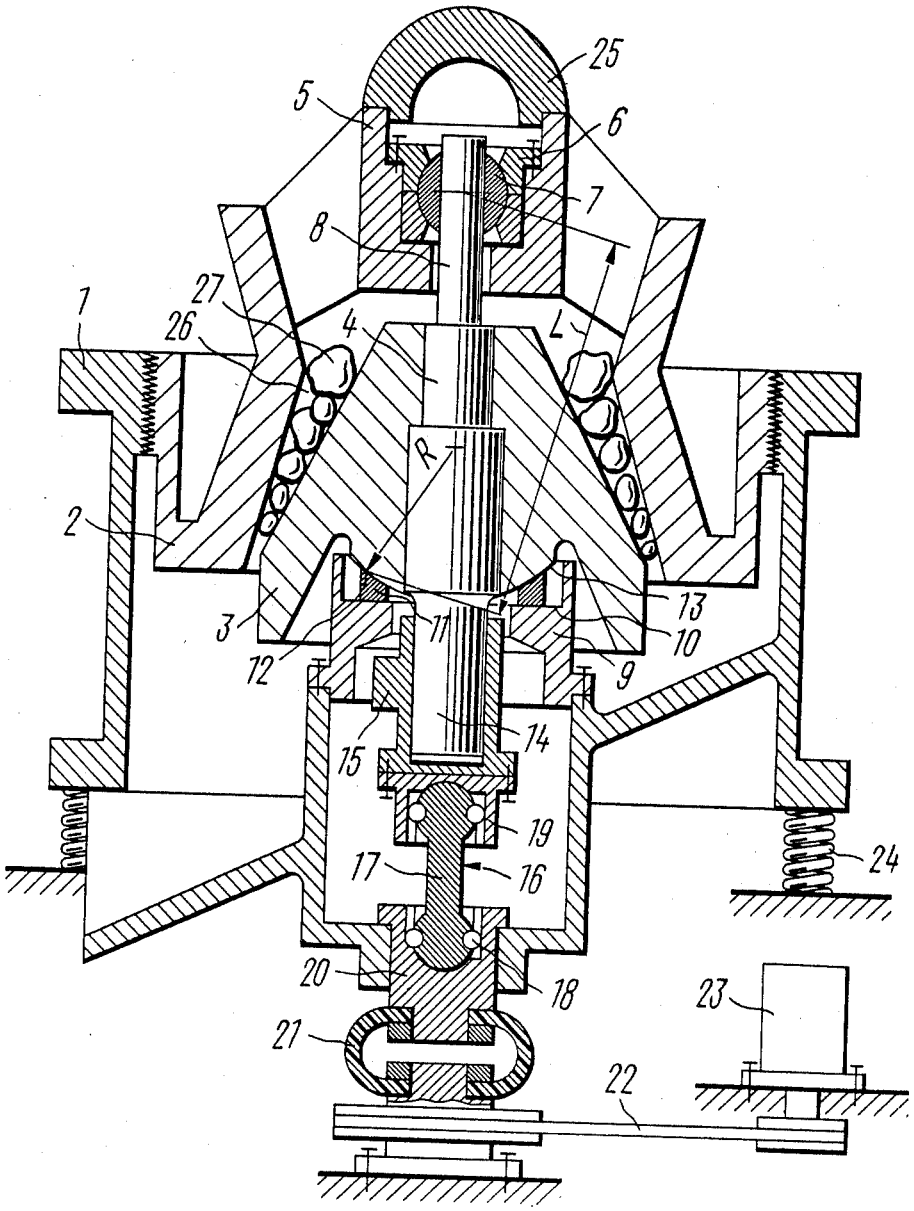
25
5
6
7
8
27
26
1
4
L
R
2
3
12
11
13
10
9
14
15
19
17
16
24
20
18
23
21
22

GYRATORY CRUSHER

FIELD OF THE INVENTION

This invention relates to devices for crushing ore, construction materials, chemical components and metal chips. More specifically it concerns gyratory crushing mechanisms.

The invention can find application in ferrous and non-ferrous metallurgy, in the production of construction materials and in the chemical industry. It can be employed as successfully for abrasive treatment and production of metal powders.

BACKGROUND OF THE INVENTION

A gyratory crusher construction which bears the closest resemblance to the one to be described in this specification is disclosed in USSR Inventor's Certificate No. 578,098; IPC B 02 C 2/04, published 1978. This prior art crusher comprises a housing having arranged therein an adjustment ring which in turn accommodates a crushing cone with a bearing spherical surface and a shaft press fitted thereinto, an upper support of the crushing cone which is disposed in a cross-piece of the adjustment ring and includes a detachable insert with a ball joint, the interior of the ball joint receiving an upper end of the crushing cone shaft; the device further comprises a cup member adapted to underlie the crushing cone coaxially with the housing, a thrust element having a spherical surface secured on the bearing surface of the cup member and mating with the bearing spherical surface of the crushing cone, an eccentric arranged on a lower shank of the crushing cone shaft, and a drive means for rotating the eccentric. In order to prevent destabilization of the crushing cone, the crusher is provided with the ball joint and a means for vertical displacement thereof, whereas the cone shaft projects from the upper part of the crushing cone, the ball joint being mounted on this projecting portion of the shaft at a distance from the spherical surface of the thrust element equal to the radius of its sphere. In other words, the upper support of the crushing cone serves for preventing destabilization of the crushing cone or displacement thereof from the thrust element of the support cup member.

This known gyratory crusher construction requires a very high accuracy during installation of the ball joint at a distance from the spherical surface of the thrust element equal to the radius of its sphere, i.e. it is necessary to align the centers of sphere of the spherical support of the thrust element with that of the ball joint, because the failure to align these centers results in a loss of stable movement of the crushing cone to cause excessive wear of the thrust element on the edges of its spherical surface.

The centers of the ball joint sphere and the sphere of the spherical surface of the thrust element must be aligned both in the direction perpendicular to the axis of the crusher (for providing coaxiality of the ball joint with the sphere of the spherical surface of the thrust element), and in the longitudinal direction (in height). Coaxiality requires high manufacturing precision during fabrication of the parts and components of the crusher. In contrast, for aligning the centers of these spheres vertically, use is normally made of specially designed devices which require high labour expenditures, especially during spacing of the ball joint at a distance equal to the radius of sphere of the spherical surface of the thrust element, which makes assembly of the crusher a rather complicated and time consuming affair. In addition, the spherical insert with the ball joint arranged in the hole of the cross-piece of the adjustment ring and capable of displacement axially of this hole during crusher operation tends to damage the surface of this hole in the cross-piece to render the upper support of the crushing cone less reliable and consequently affect the overall reliability of the gyratory crusher.

SUMMARY OF THE INVENTION

It is an object of this invention to provide a gyratory crusher which would require less amount of labour to be consumed for its assembly and lower the precision for fabricating its parts and units.

The object is attained by a gyratory crusher comprising a housing having arranged therein an adjustment ring with a crushing cone provided with a bearing spherical surface and a shaft pressed thereinto accommodated inside the adjustment ring, an upper support of the crushing cone disposed in a cross-piece of the adjustment ring and including a detachable insert with a ball joint adapted to receive an upper end of the crushing cone shaft, a cup member having a bearing surface and arranged to underlie the crushing cone coaxially with the housing, a thrust element having a spherical surface installed on the bearing surface of the cup member, the spherical surface of the thrust element mating with the bearing spherical surface of the crushing cone, an eccentric arranged on a lower shank of the crushing cone shaft, and a drive of the eccentric. According to the invention, the thrust element is placed on the bearing surface of the cup member to be capable of being displaced thereon, the radius of sphere of the spherical surface of the thrust element being substantially less than the distance from the center of sphere of the ball joint to the spherical surface of the thrust element at any selected position of the adjustment ring.

Preferably, the detachable insert of the upper support of the crushing cone is rigidly connected to the cross-piece of the adjustment ring, the upper end of the shaft of the crushing cone being connected to the ball joint with a clearance fit.

BRIEF DESCRIPTION OF THE DRAWINGS

The invention will now be described in greater detail with reference to a specific embodiment thereof taken in conjunction with the accompanying drawings, the sole FIGURE of which shows a longitudinal sectional view of a gyratory crusher according to the invention.

DETAILED DESCRIPTION OF THE INVENTION

A gyratory crusher comprises a housing 1 with an adjustment ring 2 arranged therein, a crushing cone 3 having a shaft 4 pressed thereinto being disposed inside the ring 2. The adjustment ring 2 has a cross-piece 5 in which an upper support of the crushing cone 3 including a detachable insert 6 and a ball joint 7 are secured. An upper end 8 of the shaft 4 of the crushing cone 3 is arranged inside the ball joint 7 with a clearance fit. The housing 1 also accommodates a cup member 9 having a bearing surface 10. Mounted on the bearing surface 10 of the cup member 9 is a thrust element 11 with a spherical surface 12, the radius R of the spherical surface 12 of the thrust element being less than the distance L from the center of sphere of the ball joint 7 to the spherical surface 12 of the thrust element 11, which bears on the surface 10 of the cup member 9. The crushing cone 3 in turn bears on the spherical surface 12 of the thrust element 11 by its spherical surface 13 having the same radius R. An eccentric 15 is disposed on a lower shank 14 of the shaft 4 and connected to a drive of the eccentric 15. The drive of the eccentric 15 may have the form of a spherical spindle, or a universal joint, or an elastic coupling. The accompanying drawing illustrates the eccentric drive fashioned as a spherical spindle assembly 16 including a spindle 17, spheres 18, an upper splined ring 19, and a lower splined ring 20. The drive of the eccentric is connected through a coupling 21 of an elastic material and a transmission belt 22 to a motor 23. The housing 1 of the crusher is mounted on suspensions 24. The opening of the cross-piece 5 is enclosed by a cover plate 25. A crushing chamber 26 is defined between the outer conical surface of the crushing cone 3 and the inner conical surface of the adjustment ring 2, a material to be crushed being fed to this chamber 26.

The gyratory crusher according to the invention operates in the following manner.

The motor 23 acts to rotate the eccentric 15 relative to the lower shank 14 of the shaft 4 through the belt transmission 22 and coupling 21. Under the action of centrifugal forces, the eccentric 15 is caused to be offset from the vertical centerline of the housing 1 to carry the shank 14 of the shaft 4 as well as the crushing cone 3 therewith for the cone 3 to execute a gyratory or circular motion. The material 27 to be crushed is fed to the crushing chamber 26 to be progressively crushed as it travels toward the area where the distance between the crushing cone 3 and the adjustment ring 2 is the closest by virtue of the gyratory motion of the crushing cone 3.

In the course of operation of the gyratory crusher according to the invention the thrust element 11 is acted upon in a direction substantially perpendicular to the centerline of the housing 1 by the following forces: an active force applied to the spherical surface 12 of the thrust element 11 arising due to the centrifugal force of the eccentric and the centrifugal force of the crushing cone 3 caused by its gyratory motion and directed toward the movement of the cone; a horizontal component resulting from the forces of friction of the bearing spherical surface 13 of the crushing cone 3 on the spherical surface 12 of the thrust element 11 directed toward the movement of the crushing cone 3; and a force of friction of the thrust element 11 on the bearing surface 10 of the cup member 9 directed in opposition to the movement of the crushing cone 3. When the total of forces acting in the direction of movement of the crushing cone 3 overcome the force of friction of the thrust element 11 on the bearing surface 10 of the cup member 9, the thrust element 11 is caused to move in the direction of movement of the crushing cone 3.

The relationship between the forces acting on the thrust element 11 perpendicularly to the centerline of the housing 1 depend on the coefficient of friction in the cooperating pairs: thrust element 11—bearing surface 10 of the cup member 9; spherical surface 13 of the crushing cone 3—spherical surface 12 of the thrust element 11; and on the relationship between the values of R and L. These relationships are determined specifically for each type and size of the gyratory crusher.

When the thrust element 11 moves on the bearing surface 10 of the cup member 9, the distance L from the spherical surface 12 of the thrust element 11 to the center of sphere of the ball joint 7 is increased. However, because the upper end 8 of the shaft 4 is connected to the ball joint 7 with a clearance fit and the ball joint 7 makes it possible for the upper end 8 of the shaft 4 to turn in the vertical and horizontal planes relative to the center of sphere of the ball joint 7, then during the movement of the thrust element 11 on the spherical surface 10 of the cup member 9 together with the crushing cone 3 mounted thereon, the upper end 8 of the shaft 4 is caused to move relative to the center of sphere of the ball joint 7 whereby the bearing spherical surface 13 of the crushing cone 3 tends to fully adjoin the spherical surface 12 of the thrust element 11. The snug abutment of the bearing spherical surface 13 of the crushing cone 3 against the spherical surface 12 of the thrust element 11 ensures a reduction in the wear of the spherical surface 12 of the thrust element 12 resulting in a longer service life of the thrust element 11.

When adjusting the outlet clearance in the crushing chamber 26, the spherical joint 7 and the insert 6 rigidly affixed to the cross-piece 5 of the adjustment ring 2 is moved relative to the upper end 8 of the shaft 4 of the crushing cone 3. Due to the rigid attachment of the insert 6 to the cross-piece 5 of the adjustment ring 2, the insert 6 cannot be rolled about the surface of the opening in the cross-piece 5, which prevents surface wear of this opening in the cross-piece 5.

By virtue of the fact that the thrust element 11 can move on the bearing surface 10 of the cup member 9, it is not necessary to register the center of sphere of the ball joint 7 with the vertical axis of the thrust element 11, which in turn requires less accuracy during manufacturing of parts and components of the crusher.

Because the spherical surface 12 of the thrust element 11 has the radius R which is less than the distance L from the center of sphere of the ball joint 7 to the spherical surface 12 of the thrust element 11, that is due to the fact the center of the spherical surface 12 of the thrust element 11 is disposed below the center of sphere of the ball joint 7, extra difficulties associated with aligning these centers are eliminated to result in reduced overall amount of labour required for the assembly of the gyratory crusher according to the invention.

Assembly of the gyratory crusher embodying the invention is carried out in the following manner.

Subsequent to the arrangement of the drive of the eccentric inside the housing 1, the cup member 9 and the eccentric 15 per se are installed thereinside. The thrust element 11 is freely placed on the bearing surface 10 of the cup member 9. The crushing cone 3 with the shaft 4 pressed thereinto is mounted on the thrust element, the shank 14 being inserted in to the hole of the eccentric 15. Thereafter, the adjustment ring 2 with the upper support of the cone 3 secured in the cross-piece 5 enclosed by the cover plate is installed in the housing 1. Therefore, it is necessary that the upper end 8 of the shaft 4 of the crushing cone 3 be inserted into the hole of the ball joint 7.

The arrangement of the upper support of the crushing cone in the adjustment ring 2 independent of the installation of the crushing cone 3 on the thrust element 11 and of the positioning of the adjustment ring 2 in the housing 1 of the crusher facilitates the assembly of the gyratory crusher according to the invention.

The application of the "floating" thrust element on the cup member makes it possible to dispense with aligning the center of sphere of the ball joint and the center of sphere of the spherical surface of the thrust element, whereby the assembly of the gyratory crusher is greatly simplified and the fabrication of the parts and components of the crusher needs less precision. Furhter, the arrangement of the upper support of the crushing cone by way of the ball joint rigidly affixed in the cross-piece improves the reliability of the upper support and consequently makes the gyratory crusher embodying the features of this invention more reliable.

What is claimed is:

1. A gyratory crusher comprising:

a housing;

an adjustment ring arranged inside said housing and having a cross-piece;

a crushing cone having a bearing spherical surface;

a shaft having an upper end and a lower shank, said shaft being pressed into said crushing cone;

an upper support of said crushing cone disposed in said cross-piece of said adjustment ring and having a detachable insert and a ball joint, said upper end of said shaft of said crushing cone being disposed inside said ball joint;

a cup member having a bearing surface, said cup member being arranged to underlie said crushing cone coaxially with said housing;

a thrust element having a spherical surface, said spherical surface mating with said bearing spherical surface of said crushing cone and said thrust element being mounted on said bearing surface of said cup member to be capable of displacement thereon;

an eccentric having a drive and disposed on said lower shank of said shaft of said crushing cone; and wherein a radius of said spherical surface of said thrust element being less than a distance from a center of said ball joint to said spherical surface of said thrust element at any selected position of said adjustment ring.

2. A gyratory crusher as definded in claim 1, wherein said detachable insert of said upper support of said crushing cone is rigidly connected to said cross-piece of said adjustment ring and said upper end of said shaft of said crushing cone is connected to said ball joint with a clearance fit.

* * * * *